United States Patent [19]

Stinecipher et al.

[11] 4,300,962

[45] Nov. 17, 1981

[54] AMMONIUM NITRATE EXPLOSIVE SYSTEMS

[75] Inventors: Mary M. Stinecipher; Michael D. Coburn, both of Los Alamos, N. Mex.

[73] Assignee: The United States of America as represented by the United States Department of Energy, Washington, D.C.

[21] Appl. No.: 84,026

[22] Filed: Oct. 18, 1979

[51] Int. Cl.[3] ..... C06B 31/32

[52] U.S. Cl. ..... 149/47; 149/92

[58] Field of Search ..... 149/47, 88, 92

[56] References Cited

U.S. PATENT DOCUMENTS

| | | | |
|---|---|---|---|
| 2,168,562 | 8/1939 | Davis | 149/46 |
| 3,111,524 | 11/1963 | Wiley et al. | 149/88 |
| 3,165,753 | 1/1965 | Smith et al. | 149/47 |
| 3,909,322 | 9/1975 | Chang et al. | 149/19.4 |
| 4,110,136 | 8/1978 | Hershkowitz et al. | 149/47 |

OTHER PUBLICATIONS

Akst et al, "Explosive Performance Modification by Cosolidification of Ammonium Nitrate with Fuels, " PA-TR-4987, Oct. 1976.

*Primary Examiner*—Edward A. Miller
*Attorney, Agent, or Firm*—Edward C. Walterscheid; Paul D. Gaetjens; Richard G. Besha

[57] ABSTRACT

Novel explosives which comprise mixtures of ammonium nitrate and an ammonium salt of a nitroazole in desired ratios are disclosed. A preferred nitroazole is 3,5-dinitro-1,2,4-triazole. The explosive and physical properties of these explosives may readily be varied by the addition of other explosives and oxidizers. Certain of these mixtures have been found to act as ideal explosives.

9 Claims, 3 Drawing Figures

AMMONIUM NITRATE EXPLOSIVE SYSTEMS

It is a result of contract W-7405-Eng-36 with the Department of Energy.

BACKGROUND OF THE INVENTION

The invention described herein relates to explosive compositions and more particularly to composite explosive systems containing mixtures of ammonium nitrate and ammonium salts of nitroheterocycles.

The rate at which an explosive decomposes into its detonation products influences its performance because of the effect on the pressure and velocity of the detonation wave. Performance is also related to the kinds and amounts of the decomposition products, their rate of formation, and the energy released in forming them. Whether particular effects help performance or degrade it depends on the application to which the explosive is to be put.

Although there are certain exceptions to the general rule, an ideal explosive has been defined as one which has a decomposition rate rapid enough to be thought of as nearly instantaneous or time-independent. Most of the final products are formed by a thin, fast-moving reaction zone. Parameters such as detonation pressure and velocity can be quite well calculated on that basis, especially for condensed-phase CHNO explosives, by calibrated codes and formulas which are well known in the art.

In nonideal explosives reaction rates are usually slower, and either important amounts of chemical reaction go on well after the end of the steady-state detonation or the zone is temporally very long. Generally, detonation pressures and velocity, and hence power, are lower in nonideal explosives than in ideal explosives. As but one example, calculations based on ideal behavior predict that a mixture of HMX and lithium perchlorate should give 110% of the performance of pure HMX. However, a cylinder test showed the performance of the mixture to be significantly less than that of the pure HMX.

Presumably, by varying the reaction and pressure/-time characteristics within the total reaction zone, i.e., the detonation zone terminated by the Chapman-Jouguet plane plus the reactive region behind it, it should be possible to optimize the performance of nonideal explosives. Unfortunately, heretofore efforts to make nonideal explosives behave more "ideally", i.e., more like ideal explosives, have at best met with mixed success.

Nonetheless, nonideal energetic explosives have a significant advantage over many ideal explosives in that they can frequently be made from relatively cheap and plentiful materials, with ammonium nitrate (AN) being perhaps the best example. Nonideal explosives are usually composites, i.e., mixtures of particulate oxidizers and fuels. They may contain an ideal explosive as an ingredient. Well-known examples of nonideal explosives are ANFO (ammonium nitrate/fuel oil) and Amatex (ammonium nitrate/TNT/RDX).

It is apparent from the foregoing that it would be highly desirable to provide explosive systems of the type which have traditionally been considered nonideal explosives but which have the characteristics of ideal explosives. In particular, it would be advantageous if such explosive systems could incorporate ammonium nitrate as a primary ingredient.

It is known that the performance of nonideal explosives can be improved by more intimate incorporation of the components. Thus, for example, mixtures of gelled nitromethane with 200 μm particles of ammonium perchlorate are distinctly nonideal whereas mixtures containing 5 μm ammonium perchlorate are nearly ideal in their performance.

While it has been assumed that maximum performance can be obtained when components are combined in a continuous solid solution, heretofore no cost-effective, practical, solid-solution system has been found. Cosolidification of AN with amine nitrates, in an attempt to promote eutectic formation by the common nitrate ion, while substantially improving performance has not rendered it ideal in any explosive system thus far disclosed in the literature.

Accordingly, it is an object of this invention to provide novel explosive systems.

Another object is to provide nonideal explosive systems which perform substantially as ideal explosives.

Yet another object is to provide novel explosive systems containing ammonium nitrate as a primary ingredient.

Still another object is to provide novel explosive systems containing ammonium nitrate which act as ideal explosives.

A further object is to provide novel explosive systems containing ammonium nitrate as a primary ingredient which are castable.

Other objects, advantages and novel features of the invention will become apparent to those skilled in the art upon examination of the following detailed description of a preferred embodiment of the invention and the accompanying drawings.

SUMMARY OF THE INVENTION

We have found that the explosive performance of ammonium nitrate can be greatly improved by mixing it with an ammonium salt of a nitroazole in a desired ratio. A preferred nitroazole is 3,5-dinitro-1,2,4-triazole. We have shown that certain mixtures of ammonium nitrate and 3,5-dinitro-1,2,4-triazole act as an ideal explosive. The eutectic mixture is particularly desirable in this regard.

Explosives comprising mixtures of ammonium nitrate and an ammonium salt of a nitroazole are readily prepared by mixing the powdered components in a desired ratio, heating to a few degrees centigrade over the melting point of the eutectic of the components, stirring the resulting melt to achieve the desired uniformity, cooling, forming a powder of the resultant solid, and pressing to a desired density.

These composite explosives can in turn be used as energetic, oxygen-rich binders or as casting matrices for a wide variety of other explosives. Typically, the melt dissolves an appreciable amount of the additive explosive and holds still more as a slurry to produce desired viscosities for casting. The underwater and blast performance of these composite explosive mixtures can be improved by the addition of powdered aluminum to the melt.

The ammonium nitrate content of the composite explosives can be varied over a wide range with the ammonium nitrate being 50 wt. % or more if desired. This is quite advantageous in that ammonium nitrate is one of the most inexpensive and readily available oxidizers.

DETAILED DESCRIPTION OF THE INVENTION

As used in this application, the term "nitroazole" includes the following compounds:

2-nitropyrrole,
3-nitropyrrole,
3,4-dinitropyrrole,
2,4-dinitropyrrole,
2,5-dinitropyrrole,
2-nitroimidazole,
4-nitroimidazole,
2,4-dinitroimidazole,
4,5-dinitroimidazole,
2,4,5-trinitroimidazole,
3-nitropyrazole,
4-nitropyrazole,
3,5-dinitropyrazole,
4-nitro-1,2,3-triazole,
3-nitro-1,2,4-triazole,
3,5-dinitro-1,2,4-triazole, and
5-nitrotetrazole.

Advantageous phase relationships can be produced in mixtures of the ammonium salts of these explosives with AN because of the presence of the common ammonium ion.

The ammonium salts of 3-nitro-1,2,4-triazole [I], 3,5-dinitro-1,2,4-triazole (ADNT) [II], 3,5-dinitropyrazole [III], 4,5-dinitroimidazole [IV], 2,4-dinitroimidazole [V], 4-nitro-1,2,3-triazole [VI], 5,5'-dinitro-3,3'-bi-1,2,4-triazolyl [VII], and 5-nitrotetrazole [VIII] were prepared by bubbling ammonia gas through a solution of the nitroheterocycle in ether or ether/ethanol. The solid products were collected and recrystallized from acetone/ethyl acetate to give products with acceptable elemental analyses. The structures plus certain physical and explosive properties determined for these salts are given in Table I. Methods for preparing the parent compounds are given in the literature.

Experimental data on the formation of eutectics with ammonium nitrates (AN) was obtained by mixing together a 1/1 molar ratio of each ammonium salt with AN and subjecting the mixture to differential thermal analysis (DTA). If eutectic melting was observed at a temperature less than 140° C. then mixtures for further testing were made by heating a mixture in a ratio, which would give an oxygen balance of $CO\text{-}CO_2$, to 5° above the eutectic melting point to form a clear melt if possible. Compound VIII was not treated this way because it detonated on heating with copper oxide during elemental analysis.

Because there was an object to achieve a castable explosive, mixtures with eutectic melting points greater than 120°, or which gave unstable melts, or which had Type 12 impact sensitivity less than 40 cm were eliminated from further testing.

Figure 1:
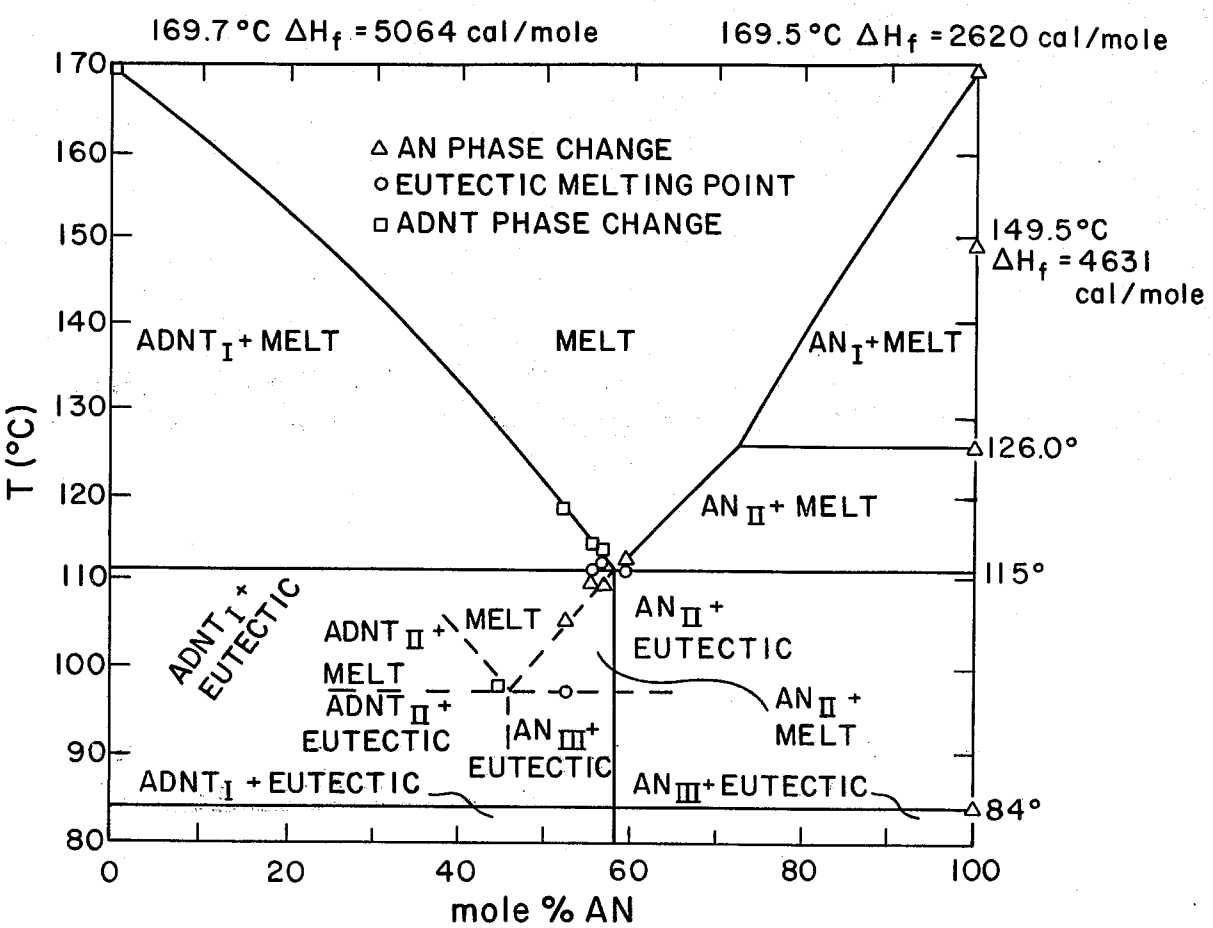
FIG. 1 is the phase diagram for mixtures of ammonium nitrate and the ammonium salt of 3,5-dinitro-1,2,4-triazole.

Mixtures of AN and ADNT(II) had a stable eutectic melting point of 112°, acceptable thermal stability (see Table IV), and Type 12 impact sensitivity of 65 cm (not a significant desensitization of ADNT (59 cm) by the addition of AN (>320 cm)); therefore, larger mixtures were prepared and small scale performance tests (Table II) were done on the $CO_2$-balanced mixture, 2/1-molar ratio AN/ADNT, and the eutectic mixture 1.38/1-molar ratio AN/ADNT (FIG. 1).

FIG. 1 shows the phase diagram for the AN/ADNT system from room temperature to the melting point. The phase transition observed for metastable phases are indicated with dashed lines. The given latent heats of fusion ($\Delta H_f$) are the values used to determine the phase lines but are not true heats of fusion, because this system

TABLE I

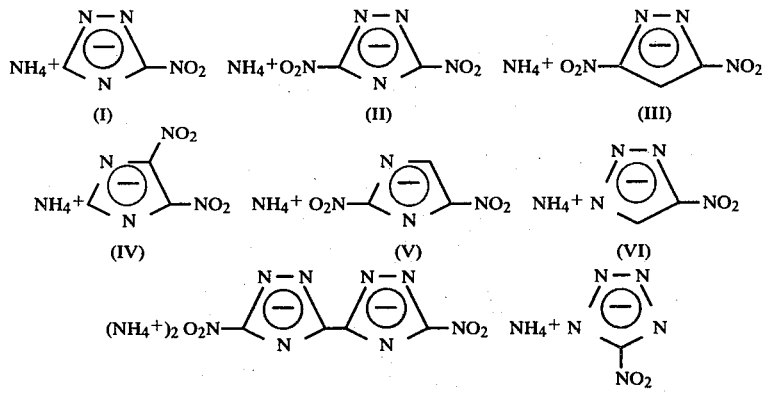

| Properties | I | II | III (VII) | IV | V | VI (VIII) | VII | VIII |
|---|---|---|---|---|---|---|---|---|
| Melting point (°C.) | 158–216 | 165–168 | 185–232 | 185–188 | 225–226 | 107–125 | unstable | 205 dec. |
| DTA (endotherm, °C.) | 140,175 | 168 | 280 | exo-235 | 226 | 180 | exo-280 | 67, 112, 205 |
| AN eutectic mp (°C.) | 120 | 112 | 167 | 165 | 152 | 120 | | 110 |
| Density (g/cm$^3$) | | 1.63 | | | | 1.67 | | |
| Impact sensitivity | | | | | | | | |
| Type 12 (cm) | >320 | 59 | 158 | 77.5 | | 235 | | 30 |
| Type 12B (cm) | | 80 | 135 | 62.6 | | 302 | | 75 |

involves common ions, and the common-ion effect has been ignored in obtaining these values.

Experimental data for the phase diagram of FIG. 1 were obtained using x-ray diffractometry, differential thermal analysis (DTA), and optical microscopy to ensure that the phases were correctly identified. The mixtures were prepared from reagent-grade AN that had been dried in a vacuum desiccator. Weighed mixtures were fused, recrystallized, and ground to prepare the samples used to determine the phase diagram.

X-ray diffraction patterns from the mixtures at room temperature had lines for $AN_{IV}$ and $ADNT_I$, as would be expected from a simple eutectic system. DTA curves showed the $AN_{IV} \rightarrow AN_{II}$ (54° C.), $AN_{III} \rightarrow AN_{II}$ (84° C.), and $AN_{II} \rightarrow AN_I$ (126° C.) transformations. The fact that all of these transformations occur at normal temperatures for pure AN implies that there has been no solid solution formed between AN and ADNT. The melting points and transition temperatures of pure ADNT and AN were determined with an optical microscope equipped with a Mettler hot stage. No solid-solid phase transitions were observed in $ADNT_I$ in the temperature region examined (20° C. to 170° C.).

The melting point of $AN_{II}$ has been determined to be 149.5° C. from the phase diagram of the system AN/-methyl ammonium nitrate, and this value was used to determine the $AN_{II}$ liquidus line in FIG. 1. Liquidus lines were estimated using the formula $$\ln N = \frac{\Delta H_f}{R}\left(\frac{1}{T_o} - \frac{1}{T}\right),$$

where N is the mole fraction of the component, $\Delta H_f$ is its latent heat of fusion, R is the gas content, $T_o$ is the melting temperature of the pure component, and T is the observed liquidus temperature. Where N, T, and $T_o$ are known for a component of a mixture, the calculated value of $\Delta H_f$ can be used to accurately calculate other values of N and T near the experimental point.

Examination of mixtures that had been cooled rapidly from the melt revealed a metastable polymorph of ADNT. This polymorph ($ADNT_{II}$) transforms slowly to $ADNT_I$ at room temperature and transforms rapidly at elevated temperatures. It is unstable with respect to $ADNT_I$ at its eutectic melting temperature and is, therefore, unstable at all temperatures above room temperature. The melting point of pure $ADNT_{II}$ is not known, but is of little consequence in that $ADNT_{II}$ transforms rapidly to $ADNT_I$ at temperatures of interest.

TABLE II

| Material | Impact Sensitivity Type 12 (cm) | Density (g/cm³) | Experimental ½" Plate Dent $P_{CJ}$ (GPa)[a] | Calculated BKW $P_{CJ}$ (GPa)[a] |
|---|---|---|---|---|
| ADNT | 59 | 1.645 | | 26.2 |
| 1/1-AN/ADNT | 65 | 1.645 | | 27.1 |
| 2/1-ADNT | 65 | 1.590 | 25.2 | 25.4 |
| | | 1.645 | 23.0 | 27.6 |
| 1.38/1-AN/ADNT | 65 | 1.630 | 27.3 | 26.7 |

[a]1 GPa = 10 kbar.

The explosive properties of AN/ADNT mixtures are given in Table II. All ratios given in Table II and elsewhere in this specification are molar ratios. The experimental Chapman-Jouguet detonation pressures given in Table II were obtained by plate dent tests run on unconfined pressed charges having 1.27 cm (0.5 in.) diameters.

The $CO_2$-balanced, fused mixture (2/1 of AN-/ADNT) with a density of 1.590 g/cm³ gave a detonation pressure which agrees quite closely with that obtained from a BKW calculation which assumes an ideal system. A second charge of the same formulation but pressed at 100° C. to a density of 1.645 g/cm³ partially failed and hence gave a lower detonation pressure. The success of the first charge was somewhat more surprising than the partial failure of the second charge in that explosives containing AN usually have failure diameter greater than 1.27 cm. Moreover, as the density increases, generally the failure diameter also increases.

A charge at the eutectic composition (1.38/1 of AN-/ADNT) and a density of 1.630 g/cm³ produced a detonation pressure which agrees excellently with the values calculated assuming ideal behavior. The results of the plate dent tests given in Table II demonstrate that AN can be made to release all of its energy at the detonation front when mixed intimately with a fuel-providing explosive. Mixtures of AN and ADNT behave as an ideal explosive.

In addition, mixtures of AN and ADNT can readily be used as energetic, oxygen-rich binders or as a casting matrix for cyclotrimethylenetrinitramine (RDX), cyclotetramethylenetetranitramine (HMX), nitroguanidine (NQ), sym-triaminotrinitrobenzene (TATB), and other explosives. Indeed, any other explosive stable at the temperature of the melt and showing no reactivity or incompatibility by DTA or vacuum stability may be dissolved or slurried into the melt. The following explosives have been tested and found compatible with the melt: explosive D (ammonium picrate), trinitrotoluene (TNT), diaminotrinitrobenzene (DATB), tripicrylmelamine (TPM), picrylaminotriazole (PATO), ethylenediamine dinitrate (EDD). An explosive which cannot be used is hexanitrobenzene (HNB), which reacts with the ammonium ion. The melt which is typically at 112°–120° C. dissolves a varying amount of explosive and holds an additional amount as a slurry. On cooling, the slurry forms a uniform solid. Solid explosive composites containing 1.38 AN/1.0 ADNT/1.5 RDX, 1.38 AN/1.0 ADNT/1.0 HMX, and 1.38 AN/1.0 ADNT/1.38 NQ were formed in this manner, pulverized and then pressed into cylinders for test firing samples. Table III gives the performances and sensitivities achieved in these tests.

Both the 1.27- and 2.54 cm (0.5- and 1.0 in.) plate-dent tests were calibrated with standard explosives to give an experimental CJ pressure. The reason for the discrepancy between the two plate-dent tests for the RDX mixture is not understood, but it is known that the 1.27-cm test has a higher error. Nor is the reason for the greater-than-calculated plate dent for both the RDX and HMX mixtures understood. The anomaly occurs only in the plate-dent test; the detonation velocity (D) measured in both the aquarium and rate-stick tests agrees closely with the calculated value.

TABLE III

| Test | 1.38/1/1.5 AN/ADNT/RDX | 1.38/1/1 AN/ADNT/HMX | 1.38/1/1.38 AN/ADNT/NQ |
|---|---|---|---|
| 1.27-cm (½-in.) plate-dent $P_{CJ}$ | 33.6 | 34.2 | 26.1 |

TABLE III-continued

| Test | 1.38/1/1.5 AN/ADNT/RDX | 1.38/1/1 AN/ADNT/HMX | 1.38/1/1.38 AN/ADNT/NQ |
|---|---|---|---|
| (GPa) | ($\rho$ = 1.708 g/cm$^3$) | ($\rho$ = 1.756 g/cm$^3$) | ($\rho$ = 1.654 g/cm$^3$) |
| BKW calculation $P_{CJ}$ (GPa) | 30.4 | 32.4 | 28.0 |
| D(mm/$\mu$s) | 8.445 | 8.647 | 8.305 |
| 2.54-cm (1-in.) aquarium-test D | 8.52 | | |
| (mm/$\mu$s) | ($\rho$ = 1.718 | g/cm$^3$) | |
| 2.54-cm (1-in.) rate-stick D | 8.455 | | |
| (mm/$\mu$5) | ($\rho$ = 1.717 g/cm$^3$) | | |
| 2.54-cm (1-in.) plate-dent $P_{CJ}$ | 31.7 | | |
| (GPa) | | | |
| Impact sensitivity Type 12 (cm) | 37 | 43 | 110 |

The aquarium test was performed by detonating a cylindrical charge in a Plexiglas aquarium filled with water. Measurements were made by taking a double exposure photograph of the shock and bubble interfaces in the water with an image-intensifier camera. The shock front is a good measure of the CJ pressure, and the bubble indicates the amount of additional reaction that occurs behind the detonation front.

Figure 2:
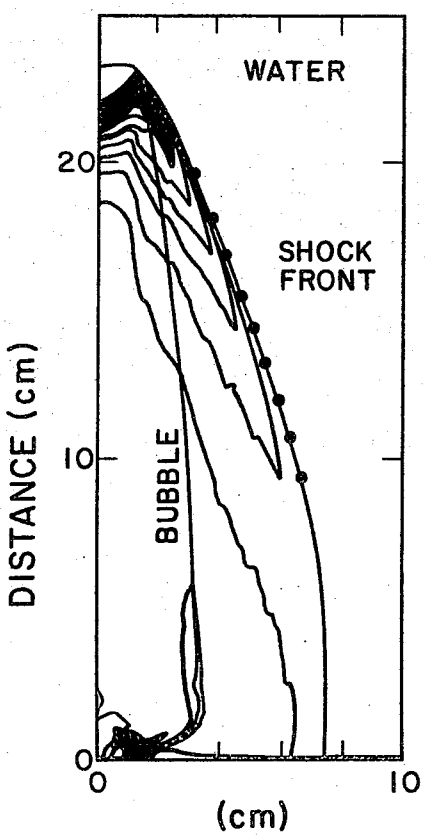
FIG. 2 shows the results of an aquarium test of 1.38/1.0/1.5 molar AN/ADNT/RDX. The wavy lines are the computer-generated shock wave curves and the points are the experimental data.

This is a very useful test for determining whether an explosive behaves nonideally. Knowing the time between exposures, the detonation velocity can be measured directly from the films, and the shock profile can be compared with the computer-drawn curve generated on the assumption that the material behaves ideally. As shown in FIG. 2, the shock-profile experimental points are vertically on the computer-drawn curve for the AN/ADNT/RDX composite of Table III. Although the bubble interface was not well defined, the agreement of the experimental shock front data with the computer calculation indicates that there is little or no late time reaction and hence that this composite behaves as an ideal explosive.

The AN/ADNT melt can also be used to improve the physical properties of other explosives. For NQ, the low-bulk density crystals can be used. When NQ is added to an AN/ADNT melt, a viscous slurry is formed, which becomes a tough solid when cooled. This solid is less sensitive to impact and more thermally stable than the AN/ADNT mixture. Sensitivity data for the AN/ADNT/NQ composite and for the other related systems are given in Table III. Table IV lists Henkin-test and vacuum stability results.

As shown in Table III, the NQ-containing solid that was pulverized and pressed to a density of 1.654 g/cm$^3$ gave almost ideal performance in the 1.27 cm diameter plate-dent test. The use of an AN/ADNT melt as a vehicle for NQ eliminates the need for the more expensive, high-bulk-density NQ, which presently must be used to fabricate plastic bonded explosives. Furthermore, the mixed system does not have a large failure diameter, even though it is a relatively insensitive material.

Figure 3:
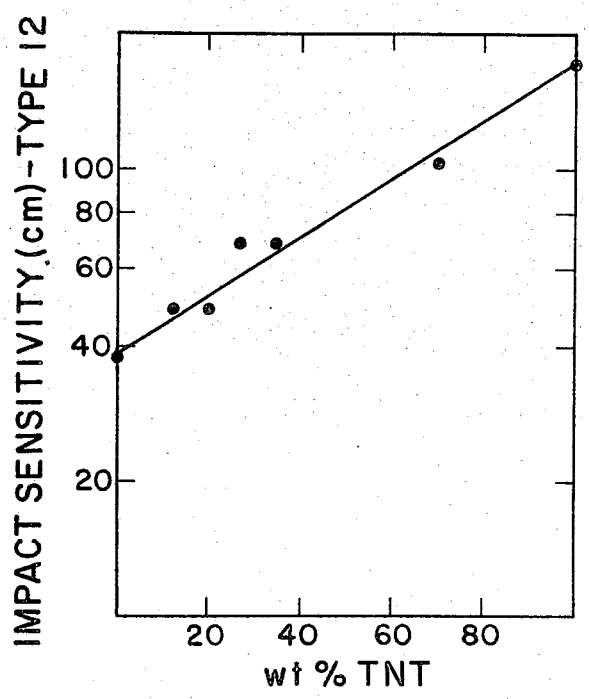
FIG. 3 shows the desensitization of 1.38/1.0/1.5 molar AN/ADNT/RDX by TNT.

Another common explosive that desensitizes the mechanical sensitivity of AN/ADNT systems and reduces the hygroscopicity of AN is trinitrotoluene (TNT). It forms a continuous second phase surrounding the AN/ADNT mixture. Data on its ability to desensitize mixtures containing AN/ADNT are given in Table V. The effect on sensitivity of a 1.38 AN/1.0 ADNT/1.5 RDX composite as a function of TNT content is shown in FIG. 3. The TNT also serves to lower the viscosity of AN/ADNT melts, thereby making casting easier.

Table VI gives comparative data on explosive properties of the 5/1/1 molar AN/ADNT/RDX system. This system is desirable from an economic viewpoint, containing as it does 50 wt % of the inexpensive AN. At this high concentration, the system no longer behaves ideally as verified by the fact that the experimentally determined detonation velocity is 90% of the calculated value. However, the system is well behaved, because the failure diameter remains less than one inch. It is readily produced as an easily handled slurry at 120°–125° C. Moreover, as also shown by the data of Table VI, the addition of aluminum serves to move the performance of this system closer to the predicted ideal performance.

TABLE IV

| Material | Vacuum Stability (ml/g/48 h at 100° C.) | Henkin Test Critical Temp. (°C.) | Henkin Test Sample Thickness (cm) |
|---|---|---|---|
| ADNT | 1.7 | 233 | 0.081 |
| 1.38/1-AN/ADNT | 0.1 | 236 | 0.079 |
| 2/1-AN/ADNT | <0.1 | 241 | 0.081 |
| 2.44/1-AN/ADNT | <0.1 | 238 | 0.081 |
| 1.38/1/1.5-AN/ADNT/RDX | 0.2 | 215 | 0.079 |
| 1.38/1/1.38-AN/ADNT/NQ | 0.1 | 256 | 0.084 |
| 1.38/1/0.38-AN/ADNT/NQ | — | 243 | 0.089 |

TABLE V

| Material | Impact Sensitivity Type 12 (cm) | Impact Sensitivity Type 12B (cm) | Henkin Critical Temp. (°C.) |
|---|---|---|---|
| 1.38/1/1.5-AN/ADNT/RDX | 37.2 | 39.1 | 215 |
| 1.38/1/1.5/0.4-AN/ADNT/RDX/TNT | 48.8 | 71.7 | 208 |
| 1.38/1/1.5/0.7-AN/ADNT/RDX/TNT | 48.8 | 68.3 | |
| 1.38/1/1.5/1-AN/ADNT/RDX/TNT | 67.6 | 62 | 214.5 |
| 1.38/1/1.5/1.5-AN/ADNT/RDX/TNT | 67.6 | 101 | 217 |
| 1.38/1/1.5/6.37- | 104 | 130 | |
| AN/ADNT/RDX/TNT | | | |
| TNT | 165 | >320 | 288 |
| 5.5/2/2/1-AN/ADNT/NQ/TNT | 90.2 | 121 | 239 |

TABLE VI

| | 5/1/1 AN/ADNT/RDX | 5/1/1/3.3 AN/ADNT/ RDX/Al |
|---|---|---|
| Impact Sensitivity | | |
| Type 12 (cm) | 44 | 38 |
| 12B (cm) | 74 | 55 |
| Henkin Critical Temp (°C.) | 219 | 221 |
| Density (g/cm$^3$) | 1.699 | 1.752 |
| 1-in. Plate Dent, $P_{CJ}$ (kbar) | 240 | 250 |
| Rate Stick, D (mm/μs) | 7.712 ± 0.001 | 7.739 ± 0.01 |
| Calculated $P_{CJ}$ (kbar) | 304 | 291 |
| D (mm/μs) | 8.598 | 8.223 |
| T (°K.) | 1805 | 3097 |
| % Ideal $P_{CJ}$ (%) | 78.9 | 86.0 |
| D (%) | 89.7 | 94.1 |

The foregoing description of a preferred embodiment of the invention has been presented for purposes of illustration and description and is not intended to be exhaustive or to limit the invention to the precise form disclosed. It was chosen and described in order to best explain the principles of the invention and their practical application to thereby enable others skilled in the art to best utilize the invention in various embodiments and with various modifications as are suited to the particular use contemplated. It is intended that the scope of the invention be defined by the claims appended thereto.

What we claim is:

1. An explosive composition which comprises a mixture in a desired ratio of ammonium nitrate and an ammonium salt of 2-nitropyrrole, 3-nitropyrrole, 3,4-dinitropyrrole, 2,4-dinitropyrrole, 2,5-dinitropyrrole, 2-nitroimidazole, 4-nitroimidazole, 2,4-dinitroimidazole, 4,5-dinitroimidazole, 2,4,5-trinitroimidazole, 3-nitropyrazole, 4-nitropyrazole, 3,5-dinitropyrazole, 4-nitro-1,2,3-triazole, 3-nitro-1,2,4-triazole, or 3,5-dinitro-1,2,4-triazole.

2. The explosive composition of claim 1 wherein said ammonium salt is the ammonium salt of 3,5-dinitro-1,2,4-triazole.

3. The explosive composition of claim 2 wherein said mixture is $CO_2$ balanced.

4. The explosive composition of claim 2 wherein said mixture is a eutectic mixture.

5. The explosive composition of claims 1, 2, 3, or 4 having in admixture therewith in a desired ratio one or more additional explosive compounds.

6. The explosive composition of claim 5 having powdered aluminum in admixture therewith in a desired ratio.

7. The explosive composition of claim 5 wherein said additional explosive compound is cyclotetramethylenetetranitramine, cyclotrimethylenetrinitramine, sym-triaminotrinitrobenzene, trinitrotoluene, pentaerythritol tetranitrate, nitroguanadine, or a mixture thereof.

8. The explosive composition of claim 7 having powdered aluminum in admixture therewith in a desired ratio.

9. The explosive composition of claim 8 wherein said additional explosive compound is nitroguanadine.

* * * * *